US008608217B1

(12) United States Patent
Meng

(10) Patent No.: US 8,608,217 B1
(45) Date of Patent: Dec. 17, 2013

(54) ELECTRONIC COMPONENT GRASPING TOOL

(75) Inventor: Jian Meng, Ontario (CA)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 13/524,443

(22) Filed: Jun. 15, 2012

(51) Int. Cl.
*B25B 9/02* (2006.01)

(52) U.S. Cl.
USPC ..... 294/99.2; 294/902

(58) Field of Classification Search
USPC ..... 294/99.2, 1.2, 3, 16, 902; 81/3.8, 6–8; 29/278, 758; 606/210
See application file for complete search history.

(56) References Cited

U.S. PATENT DOCUMENTS

| | | | | | |
|---|---|---|---|---|---|
| 1,468,718 | A | * | 9/1923 | Kneeland | 294/99.2 |
| 2,829,917 | A | * | 4/1958 | Wiora | 294/90 |
| 3,317,989 | A | * | 5/1967 | Cull | 29/747 |
| 3,861,733 | A | * | 1/1975 | Vander Mey | 294/33 |
| 3,980,861 | A | | 9/1976 | Fukunaga | |
| 4,141,138 | A | * | 2/1979 | Quick | 29/740 |
| 4,389,912 | A | | 6/1983 | Dallons et al. | |
| 4,666,199 | A | | 5/1987 | Cheh | |
| 4,723,361 | A | * | 2/1988 | Carlson et al. | 29/764 |
| 4,781,408 | A | | 11/1988 | Hernandez | |
| 4,879,806 | A | | 11/1989 | Feng | |
| 4,941,700 | A | | 7/1990 | Lin et al. | |
| 5,007,844 | A | | 4/1991 | Mason et al. | |
| D331,527 | S | * | 12/1992 | Feng | D8/52 |
| 5,190,335 | A | | 3/1993 | Rommerdale | |
| 5,334,215 | A | * | 8/1994 | Chen | 606/210 |
| 5,709,423 | A | * | 1/1998 | Romero | 294/25 |
| 6,750,431 | B2 | | 6/2004 | Miyazaki | |
| 6,866,314 | B2 | | 3/2005 | Cho | |
| 6,871,567 | B2 | * | 3/2005 | Pinana Lopez | 81/3.8 |
| 7,287,791 | B2 | * | 10/2007 | Carolina | 294/99.2 |
| 7,384,086 | B2 | | 6/2008 | Lukaszynski et al. | |

FOREIGN PATENT DOCUMENTS

| | | | |
|---|---|---|---|
| WO | JP2008187011 | A | 8/2008 |

* cited by examiner

*Primary Examiner* — Dean Kramer
(74) *Attorney, Agent, or Firm* — David J. Zwick; Bryan W. Butler

(57) ABSTRACT

A tool for grasping an electronic component that includes a first arm and a second arm resiliently joined together at one end and each separately extending to free end opposite from each other and spaced apart while at rest. The tool further includes a first and a second extension each attaching to the free end of the respective arms, and a lateral member extending from each extension towards the opposing extension. The extensions and lateral members each have at least one contact surface and the bottom surfaces of the lateral members and inner surfaces of the extensions recede from the contact surfaces, reducing the surface area of contact when an object is grasped with the tool.

18 Claims, 8 Drawing Sheets

ELECTRONIC COMPONENT GRASPING TOOL

FIELD OF THE INVENTION

The present invention relates generally to tools used for electronic component handling, and more particularly to an electronic component grasping tool for electronic card and board assembly.

BACKGROUND

Electronic devices of all types rely on the use of printed circuit boards (PCBs) of varying sizes and construction to enable the functionality of the device. PCBs make use of different connection and assembly technologies, some of which include through-hole connections and surface mount technology (SMT). Components can be attached to a PCB using one or more attachment technologies, such as: by directly soldering the component to a prepared metallic attachment pad, by inserting a component with pins into through holes, by inserting a component with pins into a socket receptacle soldered to surface attachment pads or by soldering component pins into through holes. Mass production of PCBs involves the use of complex semi-automated machines and processes to complete assembly. However, prototype design work and repair operations are typically done using manual processes and tools.

Specialized tools have been developed for facilitating various manual operations of assembly and repair of PCBs. Much of the development has been directed towards the type of operation being performed or the type of component with which the operation is being performed. Manual tool development can address specific issues of the electronics industry such as pin alignment, contamination, or fragility of the component. One type of manual tool developed for electronic assembly and rework operations can be referred to as grasping tools.

Grasping tools are used for grasping, positioning, and maneuvering components, such as inserting and removing dual in-line pin (DIP) chip components and basic electronic components such as capacitors and resistors. Electronic components have been reduced in size over time to meet consumer demands of ultra portable devices with high levels of function and high speed performance. Size reduction and electronic package consolidation have increased the sensitivity of components to handling and placement during manual assembly or repair activities. Component damage and excessive rework can result from difficulties in handling and positioning components during repair or assembly.

SUMMARY

Embodiments of the present invention provide a tool for grasping an electronic component that includes a first arm and a second arm resiliently joined together at one end and each separately extending to a free end opposite from each other and spaced apart while in a resting position, a first extension and a second extension each having a distal end and a proximal end, the proximal end of the first extension attaching to the free end of the first arm and the proximal end of the second extension attaching to the free end of the second arm, a first lateral member having a proximal end and a distal end, attaching at the proximal end of the first lateral member to the first extension, and the distal end of the first lateral member extending towards the second extension. The first lateral member has a bottom surface facing away from the joined ends of the first arm and the second arm, and the first extension has at least one contact surface positioned on an inner surface of the first extension, closer to the distal end of the first extension than to the proximal end of the first lateral member and facing the second extension.

The first lateral member of the tool additionally has at least one contact surface positioned on the bottom surface closer to the distal end of the first lateral member than to the proximal end of the first lateral member, and the bottom surface of the first lateral member and the inner surface of the first extension adjacent to the contact surfaces are receded from at least one contact surface of the first lateral member and at least one contact surface of the first extension.

The tool includes a second lateral member attached to the second extension at a proximal end of the second lateral member, such that the second extension and second lateral member form a reflective image of the first extension and first lateral member.

DETAILED DESCRIPTION

Embodiments of the present invention will now be described in detail with reference to the accompanying drawings.

Figure 1C:
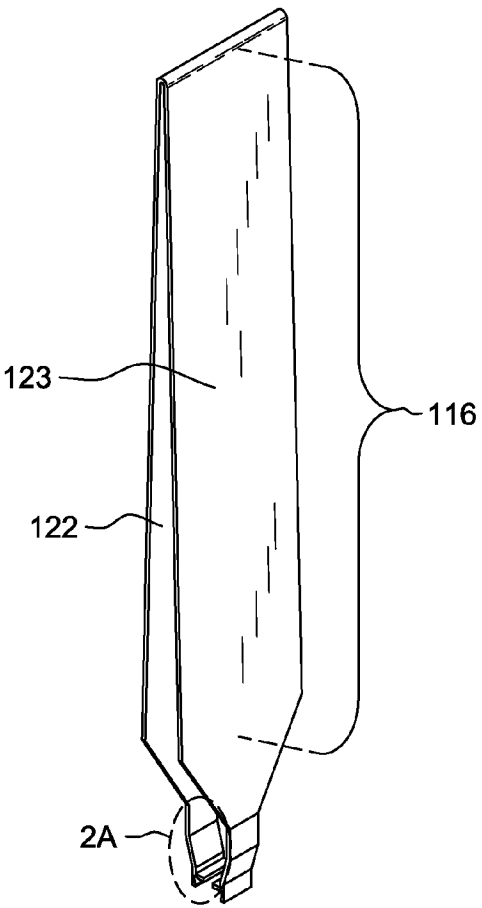
FIG. 1C depicts a second rotated view of the grasping tool of FIG. 1A in accordance with an embodiment of the present invention.
Figure 1B:
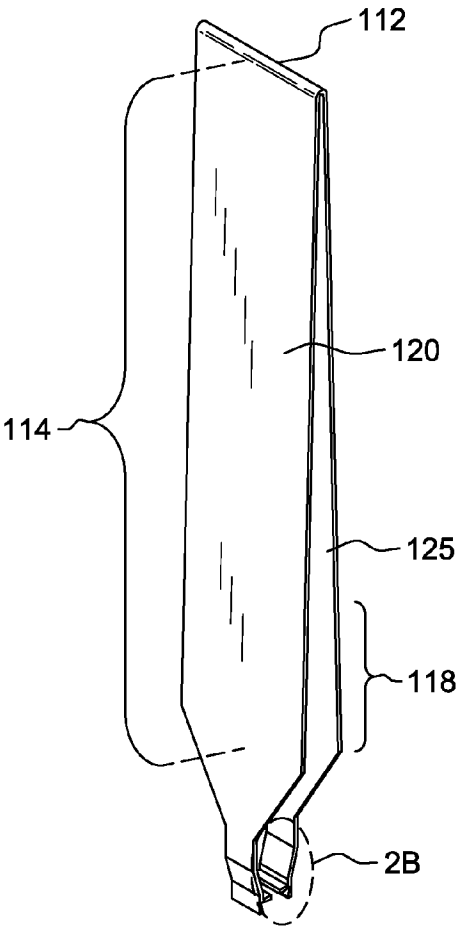
FIG. 1B depicts a rotated view of the grasping tool of FIG. 1A in accordance with an embodiment of the present invention.
Figure 1A:
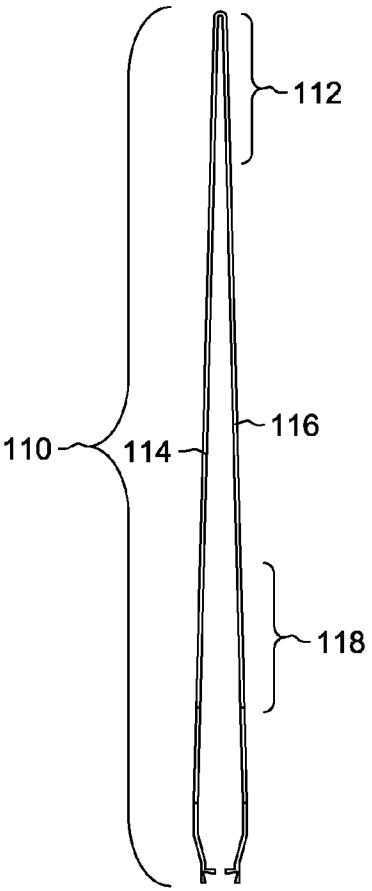
FIG. 1A depicts a grasping tool in accordance with an embodiment of the present invention.

FIG. 1A illustrates a front view of an exemplary embodiment of grasping tool 110 that includes first arm 114, and second arm 116, which are substantially minor images of each other. In one embodiment of the present invention, first arm 114 and second arm 116 are connected or joined together at joined end 112 and separated along the lengths of each arm to free end 118. First arm 114 and second arm 116 are hereafter referred to collectively, for convenience, as "the arms". FIG. 1B and FIG. 1C are angled views of grasping tool 110 depicting inner surface 125 of second arm 116 and inner surface 122 of first arm 114 that are connected, at joined end 112, such that inner surface 122 faces inner surface 125. First arm 114 has outer surface 120 and second arm 116 has outer surface 123. In general, FIG. 1A represents one embodiment in which the arms form an inverted "V" shape from joined end 112 to free end 118. The arms of grasping tool 110 can also assume a "U" shape, a "C" shape or any shape in which grasping tool 110 can grasp, hold, position and release objects, returning resiliently to a resting position after grasping pressure has been removed.

For purposes of the description presented hereinafter, the terms "upper", "lower", "right", "left", "vertical", "horizontal", "top", "bottom", "under", "front", "back", "inner", "outer", and derivatives thereof, shall be related to the disclosed structures as oriented in the drawing figures.

In an exemplary embodiment, first arm 114 and second arm 116 can be represented as separate, equal lengths of material, connected at joined end 112 and separate at free end 118; however, first arm 114 and second arm 116 may be formed from a continuous piece of material shaped by forging, bending, casting or other process, thus forming a continuation of material from first arm 114 to joined end 112 to second arm 116.

FIG. 1B and FIG. 1C illustrate an angled view of grasping tool 110 depicting first arm 114 connected to grasping portion 127 and second arm 116 connected to grasping portion 128. Grasping portion 127 and grasping portion 128 each include an arm extension and a lateral member, discussed in more detail with respect to FIGS. 2A and 2B. In one embodiment, grasping portion 127 and 128 are shown in FIG. 1B and FIG. 1C as being integrated into one continuous piece of material with first arm 114 and second arm 116, respectively.

Additionally in FIGS. 1B and 1C, grasping tool 110 depicts a tapering of the section at which first arm 114 connects to grasping portion 127 and second arm 116 connects to grasping portion 128. The amount of tapering is related to the size of the object or component with which the tool will be used. The tapering can occur entirely at free end 118 or can be shared in any proportion between free end 118 and grasping portions 127 and 128. The tapering allows the arms of grasping tool 110 to be of adequate size to facilitate manual handling and manipulation, while grasping portions 127 and 128 are of adequate size to grasp, position and hold an electronic component of desired size. The tapering displayed in FIG. 1B and FIG. 1C is representative of one embodiment of the present invention. Other embodiments may use more or less tapering or may have a more gradual taper or a less gradual taper, all of which are possible alternative implementations of the invention described herein.

Figure 2B:
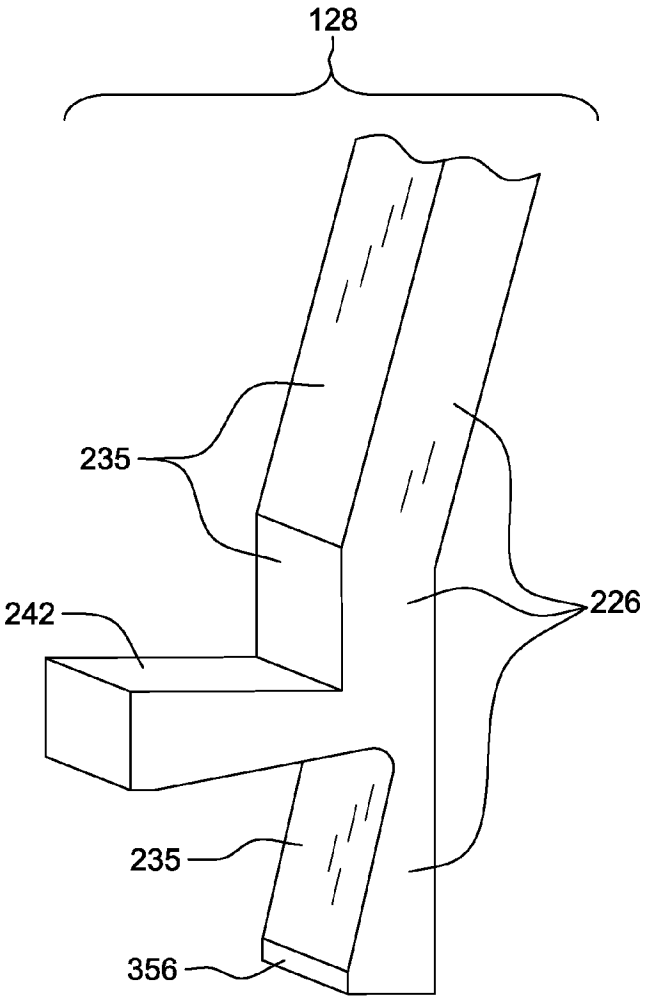
FIG. 2B depicts a detailed partial front view of a grasping portion of the tool in accordance with an embodiment of the present invention
Figure 2A:
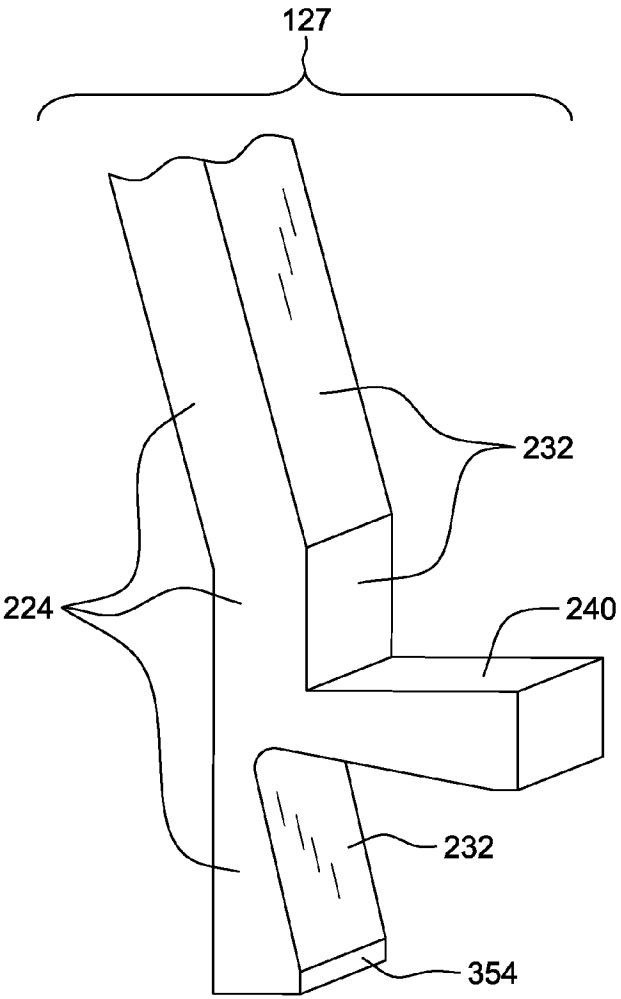
FIG. 2A depicts a detailed, partial front view of a grasping portion of the grasping tool in accordance with an embodiment of the present invention.

FIG. 2A displays a front view of grasping portion 127 that includes first arm extension 224. First arm extension 224 has a proximal end from which it attaches to free end 118 of first arm 114, and a distal end at its lower portion, extending away from joined end 112. First arm extension 224 has an inner surface, 232. Grasping portion 127 also includes lateral member 240 which has a proximal end, which attaches to inner surface 232 of first arm extension 224, and a distal end that extends towards grasping portion 128. As depicted in FIG. 2A, lateral member 240 is attached at its left (proximal) end and is unattached at its right (distal) end.

A front view of grasping portion 128 is displayed in FIG. 2B, and includes second arm extension 226, which also has a proximal end attached to free end 118 of second arm 116, and a distal end extending away from joined end 112. Grasping portion 128 includes lateral member 242, which has a proximal end attached to inner surface 235 of second arm extension 226, and a distal end, extending towards first arm extension 224. Grasping portion 127 and grasping portion 128 are positioned as mirror images of each other. FIGS. 2A and 2B also depict the positioning of surface contact 354 and surface contact 356, respectively, both of which will be discussed in more detail with regard to FIG. 3.

Grasping portions 127 and 128 operate to securely grasp an object, for example, grasping an electronic component such as a resistor for surface mount assembly. When grasping tool 110 is in a "closed" position, i.e., an inward force is applied to arms 114 and 116 respectively, lateral member 240 and lateral member 242 make contact with the top surface of the component and the distal ends of first arm extension 224 and second arm extension 226 contact opposite sides of the component.

In a preferred embodiment, grasping portion 127 and grasping portion 128 are detachably attached parts of grasping tool 110 that are attached to and removable from first arm 114 and second arm 116, respectively. For example, grasping portion 127 and grasping portion 128 can be inserted into a sleeve or a channel positioned at free end 118 of first arm 114 and free end 118 of second arm 116. Alternatively, grasping portions 127 and 128 can be attached by one or more clips, pins, threaded connections, clamps, adhesives, compression fittings, channels, slots or other connectors. Allowing the grasping portions to be changed accommodates variation in size or shape of the object with which the tool is used. In other embodiments, grasping portion 127 and grasping portion 128 can be an integral continuation of first arm 114 and second arm 116, respectively, with the appearance of one continuous piece of material.

Grasping tool 110 can be constructed of any metallic, plastic or other material such that the general form and function of grasping tool 110 as described herein, can be achieved. In one embodiment the components of grasping tool 110 are constructed of stainless steel or other metallic material, such as, for example, copper, aluminum, titanium, nickel, brass, or alloys of various metals. In another embodiment, the components of grasping tool 110 can be constructed of one or a combination of plastic materials such as, for example, polyethylene, polypropylene, polystyrene, polyvinyl chloride, and polytetrafluoroethylene (PTFE). In still other embodiments, the components of grasping tool 110 can be constructed of one or a combination of metallic, plastic or plastic-coated metallic materials. Grasping tool 100 can be constructed of any combination of materials such that when a force is concurrently applied to each arm, in the direction towards the other arm, a flexing of the arms results that enables the grasping of an object, and the arms resiliently return to a resting position when the flexing force is terminated.

Figure 3:
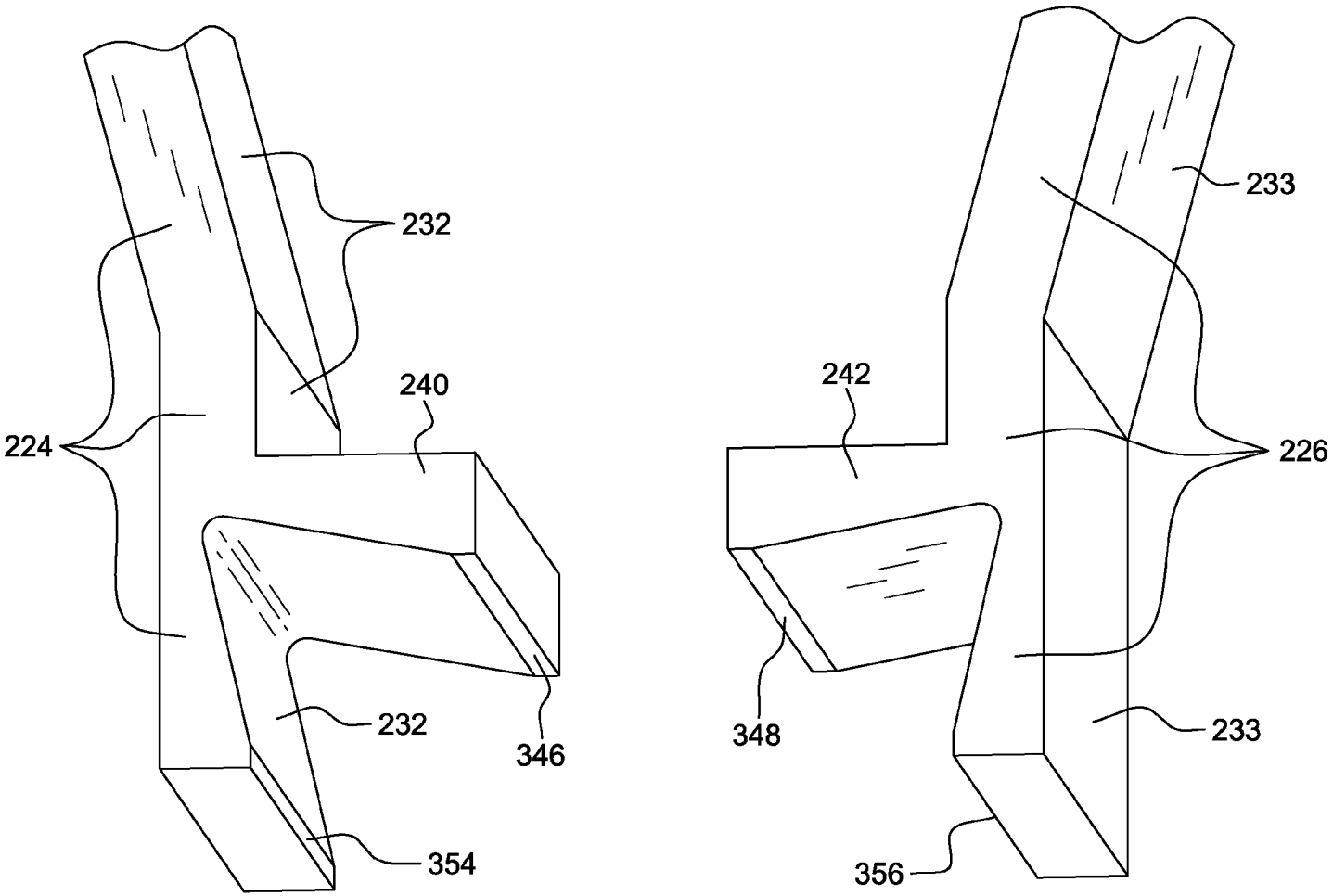
FIG. 3 depicts a detailed, partial front, bottom-angled view of the grasping portion of the grasping tool in accordance with an embodiment of the present invention.

FIG. 3 illustrates contact surface 346 and contact surface 348 positioned on the respective bottom surfaces, at the respective distal ends, of first lateral member 240 and second lateral member 242. First arm extension 224 is shown in FIG. 3 to include contact surface 354 located at the distal end of first arm extension 224, facing the distal end of second arm extension 226; and second arm extension 226 is shown to include contact surface 356 located at the distal end of second arm extension 226, facing the distal end of first arm extension 224. In an exemplary embodiment, contact surfaces 346, 348, 354, and 356 are illustrated as flat surface portions resulting from adjacent portions of the respective bottom surfaces and inner surfaces receding away from the contact surfaces. In other embodiments, contact surfaces 346, 348, 354, and 356 can be rounded, pointed, or assume other shapes, such as a ridge, for example. Additionally, contact surfaces 346, 348, 354, and 356 can have one or more points of contact when grasping tool 110 is operated to grasp an object, such as an electronic component. In yet other embodiments, contact surfaces 346 and 348 can extend outwardly from the adjacent bottom surfaces of lateral member 240 and 242 respectively. Similarly, contact surfaces 354 and 356 can extend outwardly from the adjacent inner surfaces of first arm extension 224 and second arm extension 226, respectively. Contact surfaces 346, 348, 354, and 356 can be positioned at, towards, or near the distal end, so long as the surfaces are positioned closer to the distal end than the proximal end of lateral members 240 and 242 and first arm and second arm extensions 224 and 226, respectively.

In a preferred embodiment of the present invention, when grasping tool 110 is operated to grasp an electronic component, contact surface 346 and contact surface 348, positioned at the distal ends of lateral member 240 and lateral member 242, make contact with the top of the electronic component. Contact surface 346 and contact surface 348 apply a reduced surface area of contact to the electronic component as compared to contact made with the entire bottom surface of respective lateral members 240 and 242. Similarly, contact surface 354 and contact surface 356 apply reduced surface area of contact to the sides of the electronic component as compared to contact made with the entire surface of inner surfaces 232 and 235, below the respective lateral members.

As a result of reducing the surface area in contact with the electronic component when grasping tool 110 is operated to grasp the electronic component, the grasping pressure, or force per unit of area, will increase for a given force applied to first arm 114 and second arm 116. Grasping the component with reduced contact surface instead of the entire surface, provides an increase in grasping pressure and secures holding the component while moving, positioning and performing attachment operations.

Figure 4:
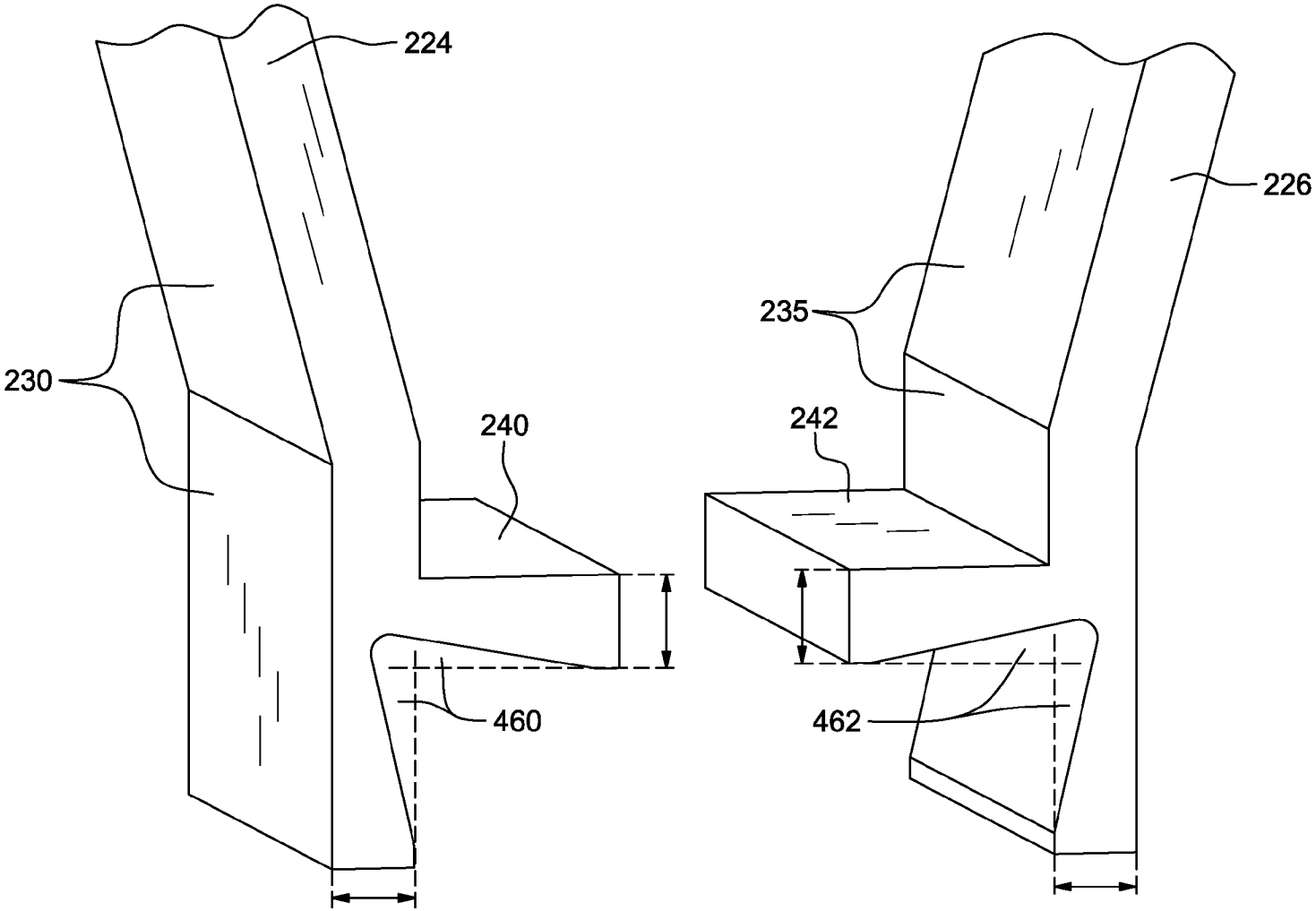
FIG. 4 depicts a detailed partial angled-front view of the grasping portion of the grasping tool in accordance with an embodiment of the present invention.

FIG. 4 displays an angled front view partially showing grasping portion 127 and grasping portion 128 and the elements of which the grasping portions are comprised. Grasping portion 127 includes lateral member 240 attached to first arm extension 224 and grasping portion 128 includes lateral member 242 attached to second arm extension 226. Additionally, outer surface 230 of first arm extension 224 and inner surface 235 of second arm extension 226 are illustrated.

In an exemplary embodiment, the under-side surface (bottom surface) of lateral member 240 tapers towards the top-surface of lateral member 240. The tapering extends from contact surface 346 (FIG. 3) at the distal end of lateral member 240 to the proximal end of lateral member 240, which connects to first arm extension 224. This results in the distance between the under-side and top side of lateral member 240 decreasing from contact surface 346 to the point of attachment of lateral member 240 to first arm extension 224. In the same manner, first arm extension 224 tapers from contact surface 354 along inner surface 232 to the attachment intersection of lateral member 240. The tapering is such that inner surface 232 tapers towards outer surface 230, resulting in a decrease of the distance between inner surface 232 and outer surface 230 from contact surface 354 (FIG. 3) to the point of attachment of lateral member 240. There is a similar tapering associated with lateral member 242 and contact surface 348 and with second arm extension 226 and contact surface 356.

When grasping tool 110 is operated by grasping an orthogonal object, such as a regularly shaped electronic component, gaps are formed between the surfaces adjacent to the contact surfaces of grasping portion 127 and the electronic component. A gap is formed between the top of the electronic component and the bottom surface of lateral member 240, extending from contact surface 346 to the attachment of lateral member 240 to first arm extension 224. Similarly, a gap is formed between the side of the component and inner surface 232 of first arm extension 224, extending from contact surface 354 to the point of attachment of lateral member 240. These form a combined gap, collectively referred to as first interstice 460. Grasping portion 128 forms a minor-image of grasping portion 127 and includes lateral member 242 and second arm extension 226. Grasping portion 128 similarly forms gaps when grasping tool 110 is operated to grasp a regularly shaped electronic component. The combined gaps of grasping portion 128 are collectively referred to as second interstice 462. The interstices are formed as a result of the positioning and reduced surface area of contact surfaces 346, 348, 354, and 356. For example, when grasping portions 127 and 128 grasp a resistor to be used in a surface mount connection, contact surface 346 and contact surface 348 limit the surface area contacting the top of the resistor, and similarly, contact surface 354 and contact surface 356 limit the surface area contacting the sides of the resistor. The remaining portion of the surfaces that are not in contact with, but face the resistor, outline first interstice 460 and second interstice 462.

Surface mount electronic components are often attached to various electronic packaging devices such as PCBs, thick film substrates, and other packaging devices, by soldering techniques that involve applying a high temperature heat source to the solder and flux materials, and to the component and surface of attachment. When the heat source is applied to the flux or flux-solder mixture, residues typically result that can adhere to the grasping sections of a manual assembly tool. The residue can inhibit a clean release of the component after attachment and can cause shifting during positioning and attaching activities. To avoid this, components may need to be held in place for longer periods of time to reduce shifting and movement during release, which adds additional time to each step or requires additional rework if components are not correctly attached. By including first interstice 460 and second interstice 462 in a preferred embodiment, a component can be grasped, held and positioned more securely, thus reducing instances of movement and shifting during attachment operations. After attachment, a more consistent, clean release can be achieved due to the interstices providing a separation from potential contaminate build up that can create an adhesive connection to components that can range to very small sizes. For example, grasping tool 110 with first and second interstices 460 and 462, respectively, is operated to hold and position a surface mount resistor to a thick film electronic packaging surface. When adequate heat is applied to the resistor and the solder-flux mixture, the flux produces a residue and some of the residue attaches to surfaces of grasping tool 110. However, due to the interstices formed, the attached residue that contacts the resistor is reduced and thus releasing the resistor results in stable positioning and avoids adhesive connection to the electronic component that can cause placement issues at release.

Figure 7:
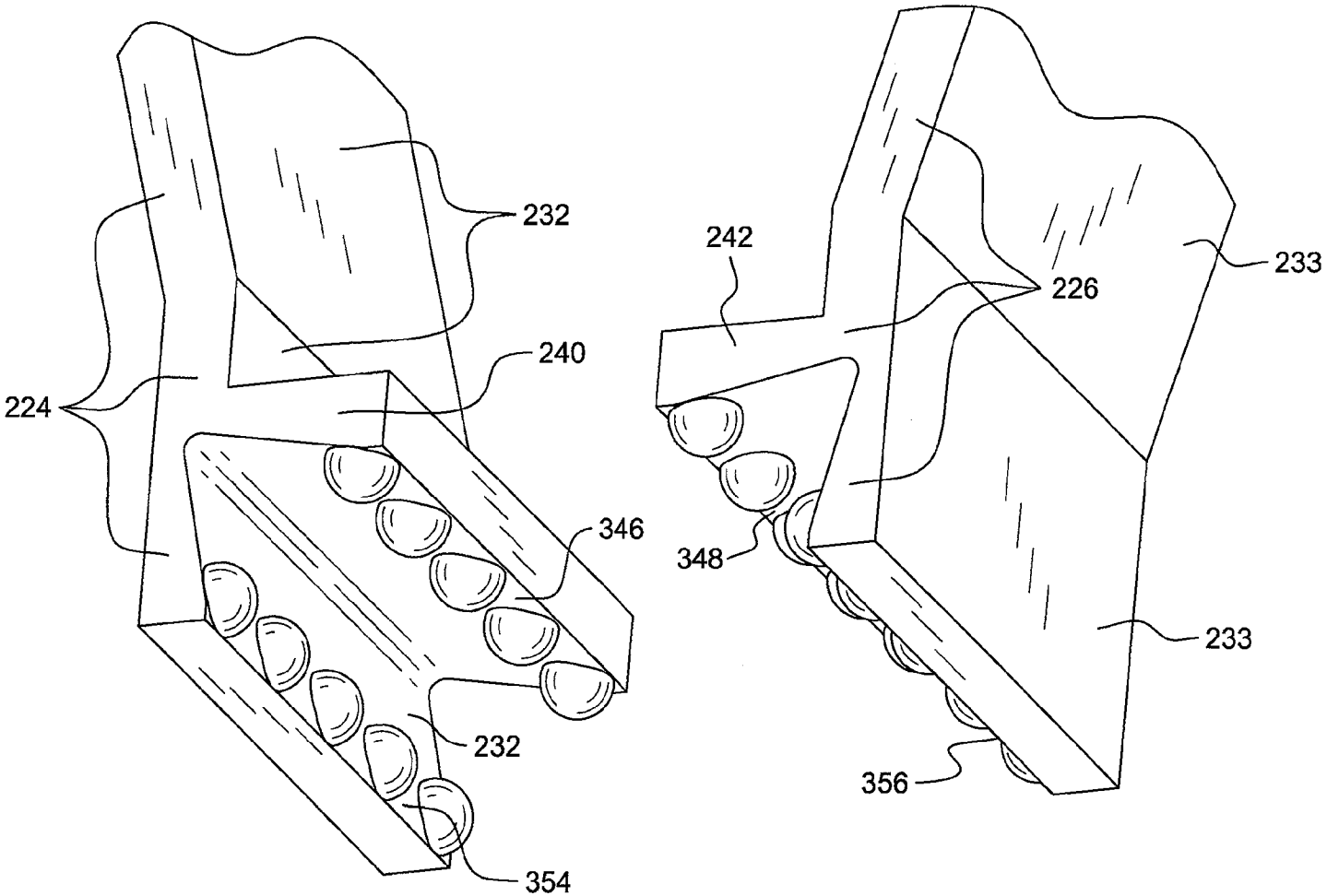
FIG. 7 depicts a detailed partial front, bottom angled view of non-planar contact surfaces of the grasping portion of the grasping tool, in accordance with an embodiment of the present invention.
Figure 8:
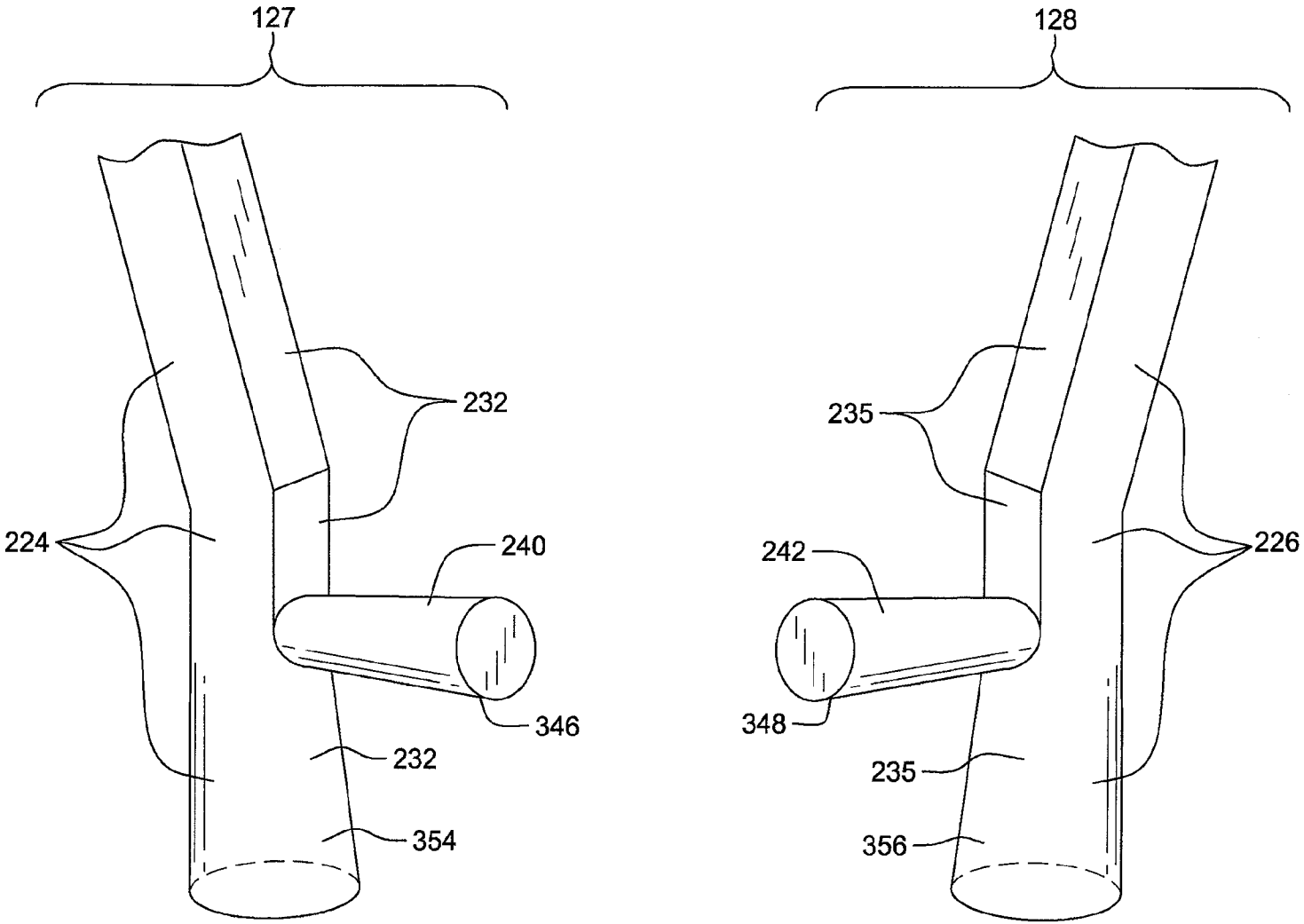
FIG. 8 depicts a partial front, side view of rounded contact surfaces of the grasping portion of the grasping tool, in accordance with an embodiment of the present invention.

It should be noted that in other embodiments of the present invention the top surface of first member 240 and second member 242 have no requirement to be flat as illustrated in FIGS. 2A, 2B, 3, and 4, and the general shape of lateral members 240, 242 and arm extensions 224, 226 is not limited to having a rectangular cross-section as illustrated in the drawings. First arm 114, first arm extension 224, lateral member 240, and their mirror-image counterparts, can be rounded or elliptical, as shown in FIG. 8, or can be triangular or of any cross-sectional shape that can produce the reduced surface contact area and interstices, and perform the operation of grasping an object as described above. Surface contacts 346, 348, 354, and 356 are illustrated in FIGS. 2A, 2B and 3 as flat continuous surfaces, which represent one embodiment. In other embodiments, the contact surfaces can be discontinuous, as shown in FIG. 7, and can be rounded or elliptical, as shown in FIG. 8, or narrowed to a ridge, saw-toothed (FIG. 5) or assume other configurations that reduce the surface area of contact to a portion of the broader surface that would typically contact the object being grasped.

Figure 5:
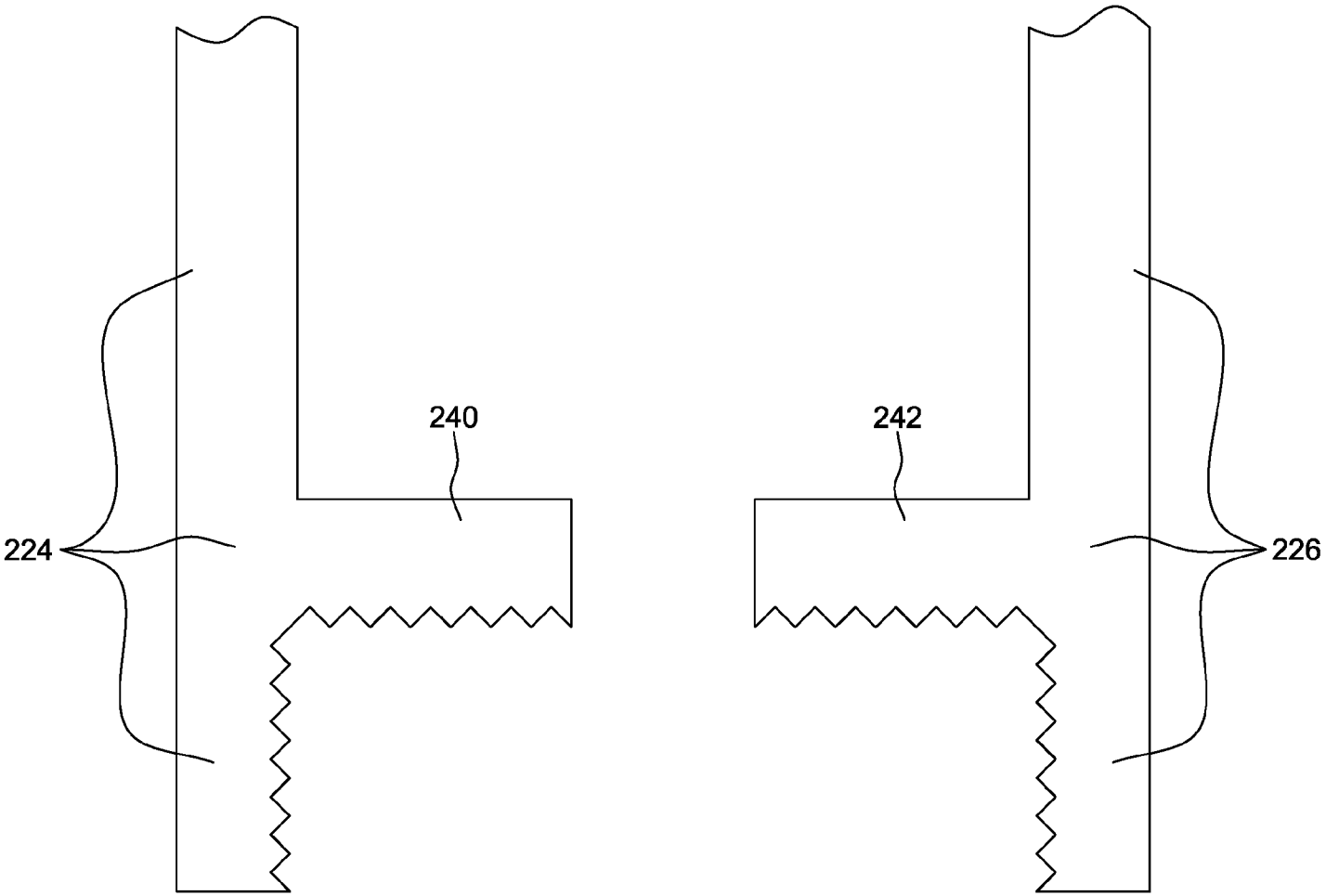
FIG. 5 depicts a front view of the grasping portion with an alternative structure in accordance with an embodiment of the present invention.

FIG. 5 presents an embodiment in which the angled structure of first arm extension 224 and second arm extension 226 has been modified to a linear alignment. The contact surfaces of the first lateral member 240 and second lateral member 242 and the contact surfaces of the first arm extension 224 and second arm extension 226 include a saw-tooth topography that effectively reduces the surface area of contact when grasping tool 110 is operated to grasp or hold an object. The removal of the angled structure of first arm extension 224 and second arm extension 226, and the saw-tooth contact surfaces, may facilitate construction of the grasping tool and offer a lower cost of construction.

Figure 6A:
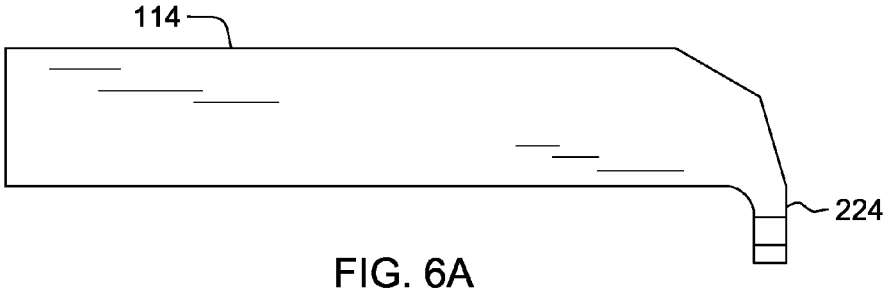
FIG. 6A depicts a side view of an angle of attachment of an arm extension to an arm of the grasping tool in accordance with an embodiment of the present invention.
Figure 6B:
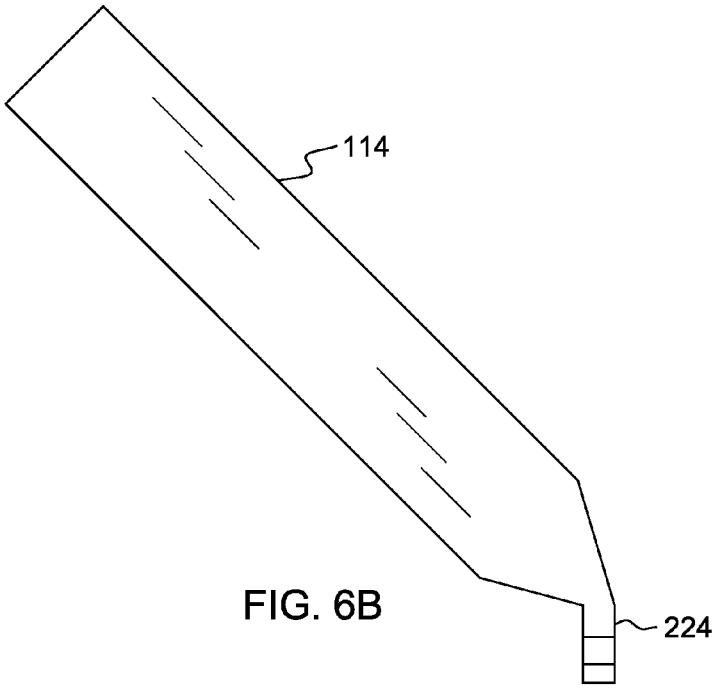
FIG. 6B depicts a side view of the angle of attachment of the arm extension to the arm of the grasping tool in accordance with an embodiment of the present invention.
Figure 6C:
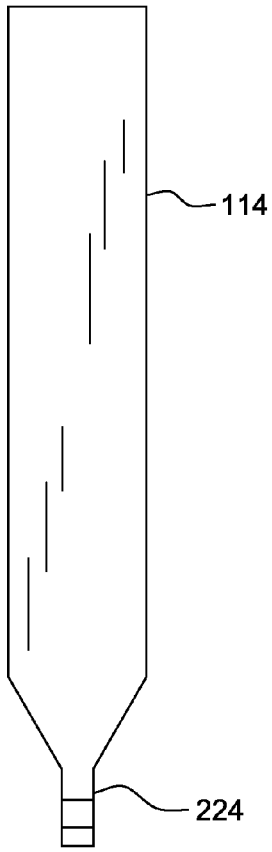
FIG. 6C depicts a side view of the angle of attachment of the arm extension to the arm of the grasping tool in accordance with an embodiment of the present invention.

FIGS. 6A, 6B, and 6C, illustrate side views of grasping tool 110 that includes an exemplary embodiment of the present invention in which first arm extension 224 is attached to first arm 114 forming an attachment angle. FIG. 6A depicts an exemplary embodiment in which first arm 114 is attached at a substantially right angle to first arm extension 224. FIG. 6B depicts an embodiment in which first arm 114 is attached to first arm extension 224 forming an angle of attachment that extends beyond a right angle. FIG. 6C depicts a preferred embodiment in which first arm 114 is attached in-line with first arm extension 224 such that first arm 114 and first arm extension 224 form a linear alignment. Although not represented in the side views of FIGS. 6A, 6B, and 6C, second arm 116 and second arm extension 226, when attached in the same alignment as first arm 114 and first arm extension 24, form the same attachment angle as formed by first arm 114 and first arm extension 224. By presenting the exemplary illustrations of FIGS. 6A, 6B, and 6C, there is no suggestion or implied limitation to the attachment angle, and, in other embodiments, the attachment angle may assume any value that facilitates the operation being performed.

The foregoing description of various embodiments of the present invention has been presented for purposes of illustration and description. It is not intended to be exhaustive nor to limit the invention to the precise form disclosed. Many modifications and variations are possible. Such modifications and variations that may be apparent to a person skilled in the art of the invention are intended to be included within the scope of the invention as defined by the accompanying claims.

What is claimed is:

1. A tool for grasping an electronic component, comprising:

a first arm and a second arm resiliently connected together at a joined end and each separately extending to a free end opposite from each other and spaced apart while in a resting position;

a first extension and a second extension each having a distal end and a proximal end, the proximal end of the first extension attaching to the free end of the first arm and the proximal end of the second extension attaching to the free end of the second arm;

a first lateral member having a proximal end and a distal end, attaching at the proximal end of the first lateral member to the first extension and the distal end of the first lateral member extending towards the second extension, and the first lateral member having a bottom surface facing away from the joined ends of the first arm and the second arm;

the first extension having an at least one contact surface positioned on an inner surface of the first extension closer to the distal end of the first extension than to the proximal end of the first lateral member and facing the second extension;

the first lateral member having an at least one contact surface positioned on the bottom surface closer to the distal end of the first lateral member than to the proximal end of the first lateral member;

the first lateral member having a top surface, oriented opposite to the bottom surface of the first lateral member, wherein the bottom surface of the first lateral member recedes from the at least one contact surface of the first lateral member, such that a distance between the bottom surface and the top surface of the first lateral member is less at the proximal end of the first lateral member than the distance between the contact surface and the top surface of the first lateral member at the distal end of the first lateral member; and a second lateral member attached to the second arm extension at a proximal end of the second lateral member, such that the second arm extension and second lateral member form a reflective image of the first extension and first lateral member.

2. The tool according to claim 1 wherein the first arm and the second arm, the first extension and second extension, and the first lateral member and second lateral member are constructed of one or a combination of: a metallic material, a plastic material, a plastic-coated metallic material.

3. The tool according to claim 1 further comprising an angle of attachment, wherein the first arm attaching to the first arm extension in a linear alignment, defines the linear alignment as the angle of attachment.

4. The tool according to claim 1, further comprising the angle of attachment, wherein the first arm attaching to the first arm extension in a non-linear alignment, defines the non-linear alignment as the angle of attachment.

5. A tool according to claim 1, wherein the first arm and second arm are constructed of a continuous piece of material.

6. A tool according to claim 1, wherein the first extension and the second extension are an integral continuation of the first arm and the second arm, respectively.

7. A tool according to claim 1, wherein the first extension and the second extension are detachably attached to the first arm and the second arm, respectively.

8. A tool according to claim 1, at such time when the tool is operated to grasp an electronic component, the at least one contact surface of the first lateral member and the at least one contact surface of the second lateral member make contact with the electronic component and the at least one contact surface of the first arm extension and the at least one contact surface of the second arm extension make contact with the electronic component, forming a first interstice between the electronic component and the bottom surface of the first lateral member and the inner surface of the first extension, and forming a second interstice between the electronic component and the bottom surface of the second lateral member and the inner surface of the second extension.

9. A tool according to claim 8, wherein the at least one contact surface of each of the first lateral member, the second lateral member, the first arm extension and the second arm extension, has more than one point of contact.

10. A tool according to claim 1, wherein the at least one contact surface of the first lateral member and the at least one contact surface of the second lateral member extend from the bottom surface of the first lateral member and the bottom surface of the second lateral member, respectively, and the at least one contact surface of the first extension and the at least one contact surface of the second extension extend from the inner surface of the first extension and the inner surface of the second extension, respectively.

11. A tool according to claim 1, wherein the at least one contact surface of the first lateral member, the second lateral member, the first arm extension and the second arm extension, respectively, has a rounded shape.

12. A tool according to claim 1, wherein the at least one contact surface of the first lateral member, the second lateral member, the first arm extension and the second arm extension, respectively, has a pointed shape.

13. A tool according to claim 1, wherein the at least one contact surface of the first lateral member, the at least one contact surface of the second lateral member, the at least one contact surface of first arm extension and the at least one contact surface of second arm extension, respectively, has a flat surface.

14. A tool according to claim 1, wherein the at least one contact surface of the first lateral member, the at least one contact surface of the second lateral member, the at least one contact surface of the first arm extension and the at least one contact surface of the second arm extension, respectively, forms a ridge.

15. A tool according to claim 1, wherein the at least one contact surface of the first lateral member, the at least one contact surface of the second lateral member, the at least one contact surface of the first arm extension and the at least one contact surface of the second arm extension, respectively, forms a non-planar surface.

16. A tool according to claim 1, wherein the at least one contact surface of each of the first lateral member, the second lateral member, the first arm extension and the second arm extension, has more than one point of contact.

17. A tool according to claim 1, wherein the first arm and the second arm are constructed such that from a resting position, concurrently applying a force on the first arm and the second arm, results in the distal end of the first arm extension moving towards the second arm extension and the distal end of the second arm extension moving towards the first arm extension, and the first arm extension and the second arm extension returning to the resting position when the force that is concurrently applied, is terminated.

18. A tool for grasping an electronic component, comprising:

a first arm and a second arm resiliently connected together at a joined end and each separately extending to a free end opposite from each other and spaced apart while in a resting position;

a first extension and a second extension each having a distal end and a proximal end, the proximal end of the first extension attaching to the free end of the first arm and the proximal end of the second extension attaching to the free end of the second arm;

a first lateral member having a proximal end and a distal end, attaching at the proximal end of the first lateral member to the first extension and the distal end of the first lateral member extending towards the second extension, and the first lateral member having a bottom surface facing away from the joined ends of the first arm and the second arm;

the first extension having an at least one contact surface positioned on an inner surface of the first extension closer to the distal end of the first extension than to the proximal end of the first lateral member and facing the second extension;

the first lateral member having an at least one contact surface positioned on the bottom surface closer to the distal end of the first lateral member than to the proximal end of the first lateral member;

the first arm extension having an outer surface, wherein the inner surface of the first arm extension recedes from the at least one contact surface of the first arm extension, such that a distance between the inner surface and the outer surface of the first arm extension is less at the proximal end of the first lateral member, than the distance between the contact surface and the outer surface of the first arm extension at the distal end of the first arm extension; and a second lateral member attached to the second arm extension at a proximal end of the second lateral member, such that the second arm extension and second lateral member form a reflective image of the first extension and first lateral member.

* * * * *